US007938529B2

(12) United States Patent
Choi et al.

(10) Patent No.: US 7,938,529 B2
(45) Date of Patent: May 10, 2011

(54) PHOTO PRINTER

(75) Inventors: Jae-hoon Choi, Seoul (KR); Ji-hwan Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 964 days.

(21) Appl. No.: 11/645,759

(22) Filed: Dec. 27, 2006

(65) Prior Publication Data

US 2007/0242122 A1 Oct. 18, 2007

(30) Foreign Application Priority Data

Apr. 14, 2006 (KR) ..... 10-2006-0034205

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 5,897,258 A * 4/1999 Wen et al. ..... 400/579
6,488,371 B2 * 12/2002 Kosaka et al. ..... 347/104

FOREIGN PATENT DOCUMENTS

| | | |
|---|---|---|
| JP | 61-111250 | 5/1986 |
| JP | 02-13527 | 1/1990 |
| JP | 03-92369 | 4/1991 |
| KR | 2004-66392 | 7/2004 |
| KR | 2005-363 | 1/2005 |

OTHER PUBLICATIONS

Korean Office Action dated Apr. 6, 2007 issued in KR 2006-34205.

* cited by examiner

*Primary Examiner* — Stephen D Meier
*Assistant Examiner* — Alexander C Witkowski
(74) *Attorney, Agent, or Firm* — Stanzione & Kim, LLP

(57) ABSTRACT

A photo printer including a printer body having a printing engine disposed therein, a conveying unit to reciprocate a printing medium supplied to the printing engine, a supplying unit disposed at an upper portion of the printer body to supply the printing medium to the printing engine, a supplying passage to guide the printing medium from the supplying unit to the printing engine, a retrograding passage disposed in the printer body to guide a preceding end of the printing medium inside and outside the printer body when the printing medium supplied to the printing engine is aligned and reciprocated, so that the printing medium is printed from a rear end thereof, and a discharging passage to discharge the printing medium outside the printer body when the printing of the printing medium is completed at the printing engine.

30 Claims, 3 Drawing Sheets

PHOTO PRINTER

CROSS-REFERENCE TO RELATED APPLICATIONS

This application claims priority under 35 U.S.C. §119(a) of Korean Patent Application No. 10-2006-34205, filed Apr. 14, 2006, in the Korean Intellectual Property Office, the disclosure of which is hereby incorporated in its entirety by reference.

BACKGROUND OF THE INVENTION

1. Field of the Invention

The present general inventive concept relates to an image forming apparatus, and more particularly, to a photo printer.

2. Description of the Related Art

With wide spread use of digital cameras, users of digital cameras who want to output and keep photographic images taken by the digital camera on a printing medium, such as a photo printing paper, as well as store them in a storage medium, such as a hard disc drive of a computer, are tending to increase.

To satisfy such users' desires, a photo printer has been developed. The photo printer is an article which is not used for general image printing but instead for photograph printing.

Various types of photo printers have been proposed and used with the spread of digital cameras. Early photo printers print only photographic images, which are stored in the storage medium after being shot by the digital camera, whereas present photo printers directly receive photographic image data from the digital camera and print the photographic image data onto a printing medium while providing various image editing functions.

Recently, a photo printer has been developed which has a size reduced enough to carry as compared with a conventional standing type photo printer, edits photographic image data stored in its own memory as well as the storage medium of a computer, and/or prints photographic images shot by a high performance camera phone that has a resolution of more than five million pixels.

Also recently, photo printers have been commercialized which print photographic images taken by digital cameras using printing techniques such as an inkjet method, a dye sublimation thermal transfer method, a direct thermal method, etc.

Photo printers are generally provided with a printing engine to print a photographic image and conveying rollers to convey the printing medium. In an inkjet photo printer, the printing engine includes an inkjet head, whereas in a dye sublimation thermal transfer photo printer or a direct thermal photo printer, the printing engine includes a thermal printing head (TPH).

Photo printers, such as a conventional laser color printer or the conventional inkjet printer, also have an interface unit which transmits data by wire or radio to a personal computer (PC) or a photographing apparatus, such as a digital camera. Accordingly, the photo printers can receive photographic image data from the PC or the photographing apparatus and print the photographic image data onto the printing medium.

Like the digital camera, the photo printers usually also have a small size and a light weight so that a user can easily carry it. Accordingly, the photo printers are advantageous in that while being carried with the photographing apparatus, a user can directly transmit photographic images shot by the photographing apparatus to the photo printer and print the photographic images.

However, contrary to the photo printers of small size and light weight as described above, the printing medium used with these photo printers usually has a relatively larger size as compared with the photo printer itself. Accordingly, the photo printer should be configured so that a medium cassette for supplying the printing medium has a size larger than that of a printer body of the photo printer, thereby requiring an additional space for supplying the printing medium to the photo printer.

Also, to print a color image on the supplied printing medium, the photo printer, such as the dye sublimation thermal transfer photo printer or the direct thermal photo printer, has to reciprocate the printing medium in a front and rear direction several times. Accordingly, to stably reciprocate the printing medium in the front and rear direction and at the same time print the color image onto the printing medium with developers of colors, such as yellow, magenta, and cyan, and a coating agent, sufficient spaces should be built in a front of the printer body on which the medium cassette is located and in a rear (or front) of the printer body from which the printing medium is discharged.

As described above, in the conventional photo printers, a problem occurs in that contrary to the intention to have a small size and light weight for the photo printer, separate spaces are required to provide for the printing medium supplying and printing passages for the photo printer.

Also, with the conventional photo printers, a problem occurs in that the medium cassette is manufactured and installed separately from the printer body.

SUMMARY OF THE INVENTION

The present general inventive concept provides a photo printer having an improved structure that allows a printing medium to be smoothly supplied and conveyed even in a narrow space.

The present general inventive concept also provides a photo printer having an improved structure that reduces the number of parts.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may also be achieved by providing a photo printer having a printer body, the photo printer including a printing unit to form an image on a printing medium, a conveying unit to reciprocate a movement of the printing medium during a printing operation, a supplying unit to supply the printing medium towards the conveying unit, a supplying passage to guide the supplied printing medium towards the conveying unit, a retrograding passage to guide and support the reciprocating movement of the printing medium in a rearward direction of the printing body, and a discharging passage to guide and support the reciprocating movement of the printing medium in a frontward direction of the printing body and to guide a discharge of the printing medium to an outside of the printer body.

The supplying unit may include a cover-cassette pivotably disposed at a top surface of the printer body to pivot between an open position and a closed position to support a rear portion of the printing medium in the open position, a pickup plate pivotably disposed at the top surface of the printer body to support a front portion of the printing medium, and a pickup roller rotably disposed at the top surface of the printer body and above a first end of the pickup plate to pick up the printing medium supported by the pickup plate and to supply the printing medium toward the conveying unit.

The supplying unit may further include an elastic member to press the first end of the pickup plate toward the pickup roller, wherein a first end of the elastic member connects to the pickup plate and a second end of the elastic member connects to one of the top surface of the printer body or the pickup roller.

The pickup plate may include a pressing member to press the pickup plate to pivot the first end of the pickup plate toward the pickup roller.

The supplying unit further may include a dam member disposed in the printer body and facing the pickup roller to block and separate a plurality of printing media supported by the pickup plate so that only one of the plurality of printing media is picked up and supplied toward the conveying unit at a time.

The photo printer may further include a supporting projection disposed on the top surface of the printer body to support the cover-cassette when placed in the open position.

The supplying passage may include a curved inside surface of a front wall of the printer body to guide the printing medium towards the conveying unit.

The printing unit may have a rounded surface facing the curved inside surface of the front wall to guide the printing medium towards the conveying unit.

The supplying passage further may include a guide lever connected to a bottom portion of the curved inside surface of the front wall, to pivot between a blocking and an open position, the guide lever may include a pressing member to continually press the guide lever to the blocking position, the guide lever may move into the open position by a force of the printing medium being supplied towards the conveying unit and the guide lever may move back into the blocking position to prevent the printing medium from entering the supplying passage during the printing operation after the printing medium has passed the guide lever.

The conveying unit may include first and second conveying rollers rotably disposed below the printing unit and in contact with each other to move the supplied printing medium towards the retrograding passage and align a rear end of the printing medium with a print start position, and reciprocate the movement of the printing medium during the printing operation.

The retrograding passage may include a curved inside surface of a bottom wall and a back wall of the printer body to guide the reciprocating movement of the printing medium during the printing operation from the conveying unit and towards a retrograding outlet and vice versa, and the retrograding passage may include the retrograding outlet to allow a front portion of the printing medium to be disposed outside the printing body during the printing operation.

The printing unit may include a rounded surface facing the curved inside surface of the bottom wall of the printer body to guide the reciprocating movement of the printing medium along the retrograding passage.

The retrograding passage may further include a first guide member disposed in the printing body and facing a portion of the curved inside surface where the curved inside surface of the bottom wall meets the curved inside surface of the back wall, to guide the printing medium against the portion of the curved surface and along the retrograding passage.

The retrograding passage may further include a second guide member disposed adjacent to the retrograding outlet to guide the printing medium to enter the retrograding outlet.

The discharging passage may include a discharging guide to guide the reciprocating movement of the printing medium and to guide the discharge of the printing medium after the printing operation is complete, and a discharging outlet to allow a rear portion of the printing medium outside the printing body during the reciprocating movement of the printing medium and to discharge the printing medium after the printing operation is complete.

The supplying passage may branch into the discharging passage after the guide lever and the discharging passage may include a discharging guide to guide the reciprocating movement of the printing medium and to guide the discharge of the printing medium after the printing operation is complete, and a discharging outlet to allow a rear portion of the printing medium outside the printing body during the reciprocating movement of the printing medium and to discharge the printing medium after the printing operation is complete.

The discharging outlet may be disposed at a top surface of the printer body.

The discharging passage may be disposed at an opposite side to the retrograding passage to interpose the printing unit therebetween, and the retrograding passage may be approximately L-shaped.

The retrograding outlet may be disposed at a top surface of the printer body.

The foregoing and/or other aspects and utilities of the present general inventive concept may also be achieved by providing a photo printer having a printer body, the photo printer including a cover-cassette pivotably disposed at a top surface of the printer body to pivot between an open position and a closed position, wherein the cover-cassette placed in the open position supports a printing medium and supplies the printing medium towards a conveying unit, a supplying passage to guide the printing medium from the cover cassette towards the conveying unit, a conveying unit to reciprocate a movement of the printing medium during a printing operation, wherein the reciprocating movement moves the printing medium along a retrograding passage and a discharging passage, a retrograding passage to guide the reciprocating movement of the printing medium, and a discharging passage to guide the reciprocating movement of the printing medium and to guide a discharge of the printing medium to an outside of the printer body after the printing operation is complete.

The photo printer may further include a discharging outlet to allow a portion of the printing medium outside the printing body during the reciprocating movement of the printing medium and to discharge the printing medium after the printing operation is complete, and a retrograding outlet to allow a portion of the printing medium to be disposed outside the printing body during the printing operation.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
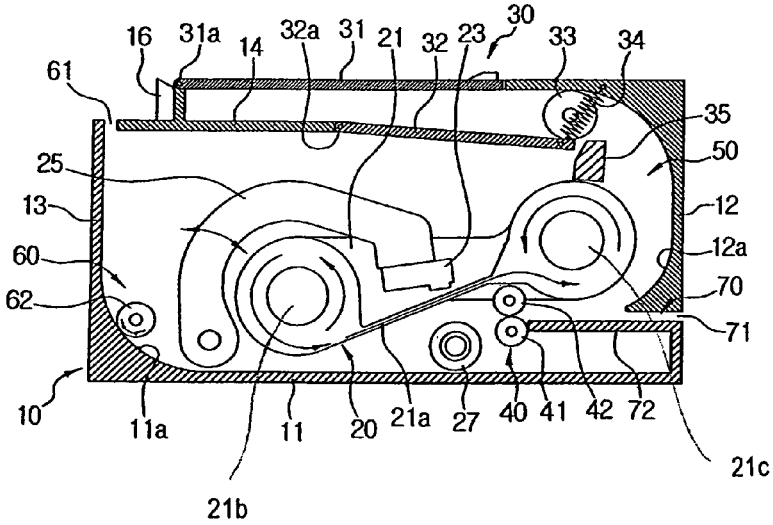
FIG. 1 is a schematic view illustrating a photo printer in accordance with an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Referring to FIG. 1, a photo printer in accordance with an exemplary embodiment of the present general inventive concept may include a printer body 10, a printing engine 20 disposed in the printer body 10, a supplying unit 30 disposed in an upper portion of the printer body 10 to supply a printing medium 1 (see FIG. 2) to be printed on, a conveying unit 40 to reciprocate the printing medium 1 supplied to the printing engine 20, a supplying passage 50, a retrograding passage 60, and a discharging passage 70, which are disposed independently of one another in the printer body 10 to guide the conveyance of the printing medium 1.

The printer body 10 can be made up of a casing having a predetermined size and shape in which a variety of electronic parts (not illustrated) including the printing engine 20 can be installed. The printer body 10, i.e., the casing, may include a bottom wall 11, a front wall 12, a rear wall 13, and a top wall 14.

The printing engine 20 prints a desired image (i.e., a color image) on the printing medium 1 supplied from the supplying unit 30. The printing engine 20 may include a ribbon cartridge 21, a thermal printing head (TPH) 23, and a driving part 25. While the printing engine 20 illustrated in FIG. 1 includes the TPH 23, the present general inventive concept is not limited thereto, and the composition of the printing engine 20 can vary depending on the type of printing head used.

The ribbon cartridge 21 has the same construction as that of a conventional ribbon cartridge generally known in the art, and includes a supplying reel 21*b* to supply a ribbon 21*a* in the cartridge body, and a withdrawing reel 21*c* to withdraw the ribbon 21*a* supplied from the supplying reel 21*b*. Developers of certain colors, i.e., yellow, magenta, and cyan, and an over-coating agent are arranged in order at predetermined areas on the ribbon 21*a* supplied from the supplying reel 21*b*. Accordingly, to form the desired color image on the printing medium 1, the printing medium 1 is reciprocated at least a total number of times corresponding to the number of colors used plus the over-coating agent. For example, in the case where only three color developers, yellow, magenta, and cyan, are used, the printing medium 1 may be reciprocated a total of four times while the ribbon 21*a* is supplied.

The TPH 23 also has the same construction as that of a conventional TPH generally known in the art. The TPH 23 presses the ribbon 21*a* against the printing medium 1 while heating the ribbon 21*a* to a predetermined temperature so that the developers and the over-coating agent on the ribbon 21*a* are transferred onto the printing medium 1.

The driving part 25, which brings or moves the TPH 23 in contact with or away from the printing medium 1, includes a rotating lever having one end to support the TPH 23 and the other end rotatably disposed in the printer body 10. The driving part 25 is provided with a driving motor or an actuator (not illustrated) to rotate the rotating lever by a predetermined angle.

In addition, the printing engine 20 further includes an elastic roller 27, which is rotatably disposed opposite to the TPH 23 to interpose the printing medium 1 therebetween.

The supplying unit 30 picks up and supplies the printing medium 1 to the printing engine 20, and includes a cover cassette 31, a pickup plate 32, a pickup roller 33, an elastic member 34, and a dam member 35, which are disposed in the upper portion of the printer body 10.

Figure 2:
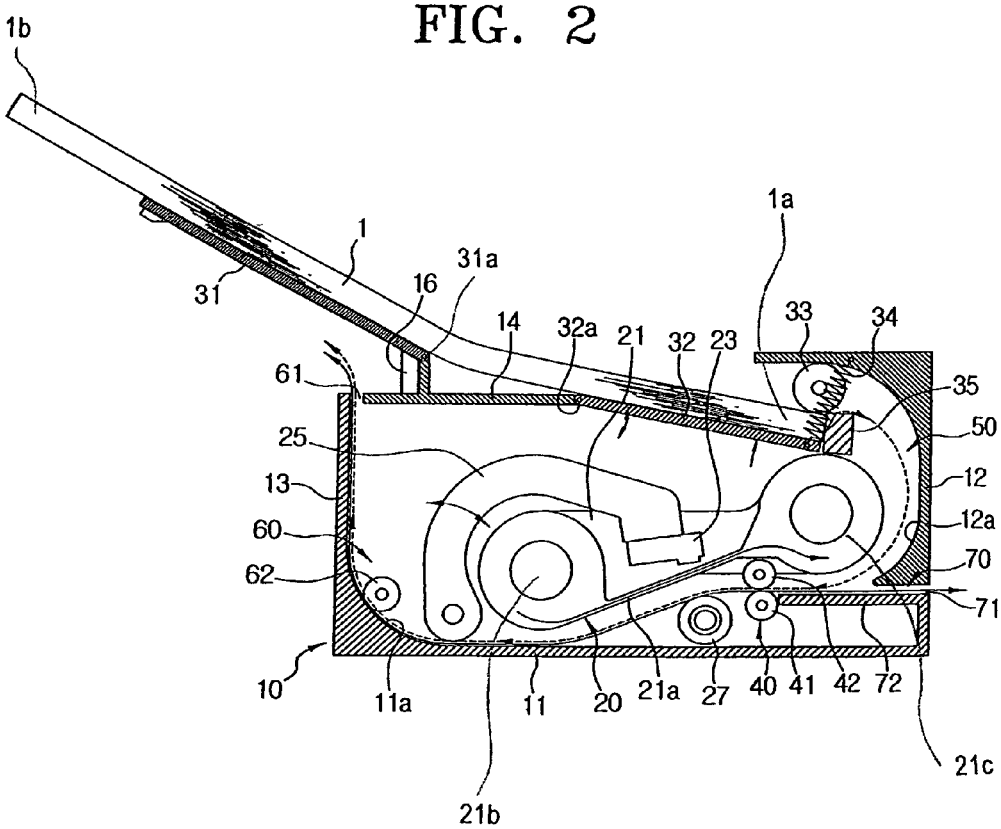
FIG. 2 is a schematic view illustrating an operation of the photo printer of FIG. 1.

The cover cassette 31 is openably disposed at the upper portion of the printer body 10 by rotatably connecting an end of the cover cassette 31 to the upper portion of the printer body 10 by a hinge 31*a*. As illustrated in FIG. 2, the cover cassette 31 supports a rear end of the printing medium 1 at a position where the cover cassette 31 is opened. To regulate an angle of opening the cover cassette 31 and to maintain the cover cassette 31 at the opened position, a supporting projection 16 is formed at the upper portion of the printer body 10. The supporting projection 16 is integrally formed with the top wall 14 of the printer body 10. The pickup plate 32 is disposed below the cover cassette 31 at the upper portion of the printer body 10 so that it is exposed to or hidden from the outside by an operation of opening or closing the cover cassette 31. As illustrated in FIG. 2, a first end of the pickup plate 32 is pivotably connected to the upper portion of the printer body 10 by a hinge 32*a*. A preceding end of the printing medium 1, i.e., a portion to be picked up by the pickup roller 33, is loaded and supported on the pickup plate 32.

The pickup roller 33 is rotatably disposed at the upper portion of the printer body 10 to face a second end of the pickup plate 32, as illustrated in FIG. 2.

The elastic member 34 elastically biases the pickup plate 32 against the pickup roller 33. The elastic member 34 can be a tension spring, one end of which is connected to the second end of the pickup plate 32 and another end of which is connected to the upper portion of the printer body 10. Accordingly, as illustrated in FIG. 2, the upper-most printing medium 1 out of a plurality of printing media 1 loaded on the pickup plate 32 can be in contact with the pickup roller 33. When the pickup roller 33 rotates, the upper-most printing medium 1, which is in contact with the pickup roller 33, is picked up by a friction force therebetween.

The dam member 35 is disposed adjacent to the second end of the pickup plate 32 so that the plurality of printing media 1 loaded on the pickup plate 32 are separated and fed one by one when they are picked up by the pickup roller 33. The dam member 35 may be fixed to the printer body 10 separately from the pickup plate 32.

With the supplying unit 30 including the cover cassette 31 and the pickup plate 32 being disposed at the upper portion of the printer body 10 as described above, it is not necessary to dispose a separate medium cassette at the front or the rear wall of the printer body 10. Accordingly, there is no need for separate and/or additional parts, thereby reducing the number of parts.

In addition, with the printing medium 1 being loaded at and supplied from the upper portion of the printer body 10, a minimum amount of space to supply the printing medium 1 at the upper portion of the printer body 10 is required. Accordingly, restrictions on a space required to use the photo printer are reduced, thereby providing for easy and convenient use of the photo printer.

The conveying unit 40 receives the printing medium 1 supplied from the supplying unit 30, reciprocates the printing medium in a front and rear direction with respect to the printing engine 20 to print a desired image thereon, and then discharges the printing medium 1 to an outside. The conveying unit 40 is provided with a pair of conveying rollers 41 and 42, which are disposed below the printing engine 20. The conveying roller 41 and 42 are rotatably disposed in contact with each other so that they are rotated in forward and reverse directions by a driving force, which is transferred from a driving source (not illustrated), such as a bi-directional rotating motor.

The supplying passage 50 guides the printing medium 1 picked-up by the supplying unit 30 to the underside of the printing engine 20. The supplying passage 50 is formed in a "C" shape and includes a rounded surface 12*a* formed at an inner side of the front wall 12 of the printer body 10.

Figure 3:
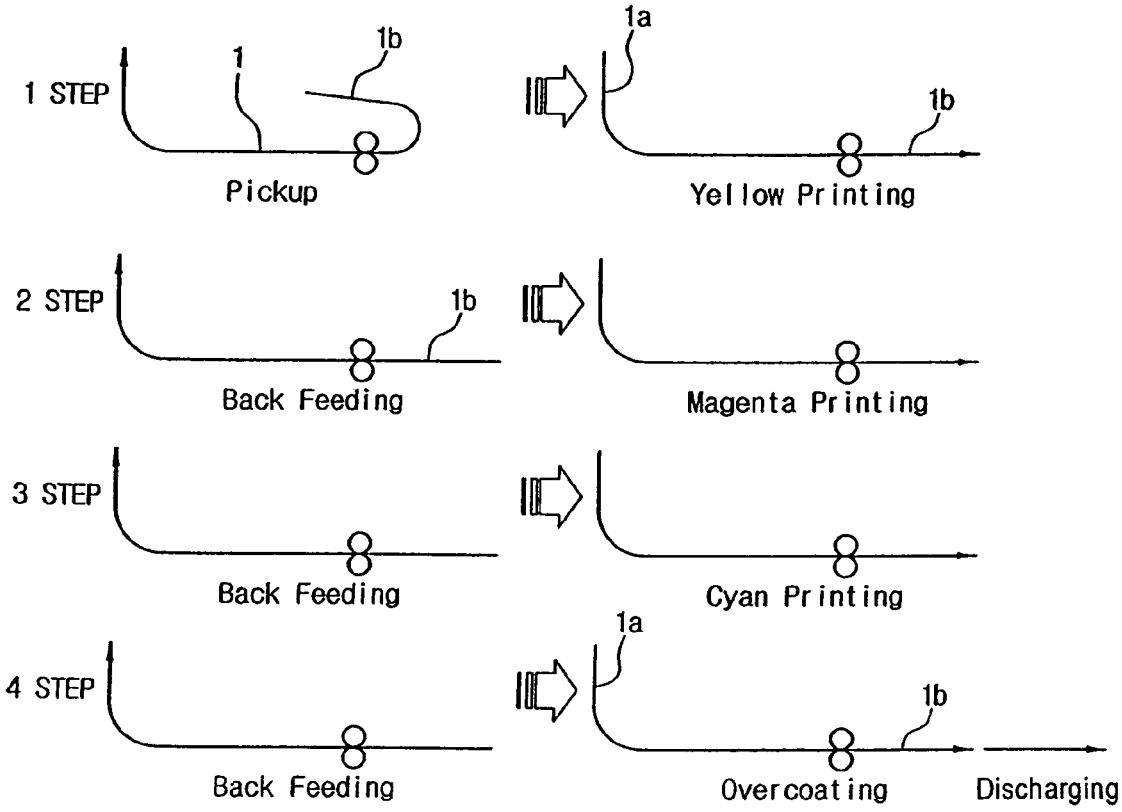
FIG. 3 is a view illustrating a conveying path of a printing medium.

As illustrated in FIG. 3, the retrograding passage 60 guides a preceding end 1*a* of the printing medium 1 supplied through the supplying passage 50 inside and outside the printer body 10, so that the preceding end 1*a* of the printing medium 1 can be retrograded rearward and allow the rear end 1*b* of the printing medium 1 to align with the underside of the printing engine 20 at a print starting position when the printing engine repeatedly carries out printing operations. The printing engine forms developer images and an over-coating layer on the printing medium 1 with developers of certain colors, e.g., yellow, magenta, cyan, and an over-coating agent, respectively, starting at the rear end 1*b* of the printing medium 1. The retrograding passage 60 includes a retrograding outlet 61 formed at the upper portion of the printer body 10, and the bottom wall 11 and the rear wall 13 of the printer body 10.

The retrograding passage 60 is configured so that the printing medium 1 can be deformed and guided in an approximately "L" shape. The retrograding outlet 61 is formed at the upper portion of the printer body 10. Thus, when the printing medium 1 is retrograded from the underside of the printing engine 20, the preceding end 1*a* of the printing medium 1 is not moved to the rear of the printer body 10, but to the upper portion of the printer body 10. Furthermore, the printing medium 1 may move inside and outside the printer body 10 using the retrograding outlet 61. Accordingly, it is not necessary to create a separate space in the rear of the printer body 10.

A boundary between the rear wall 13 and the bottom wall 11, i.e., a corner portion at which the bottom wall 11 is connected to the rear wall 13, can be rounded to form a rounded surface 11*a* to minimize a friction force against the printing medium 1. A first guide member 62 can be further disposed at a position opposite to the rounded surface 11*a*. The first guide member 62 can be made up of a rotating idle roller to support and guide the printing medium 1 to smoothly pass between the first guide member 62 and the rounded surface 11*a* without being crumpled. While the guide member 62 is illustrated in FIG. 2 as a rotating idle roller, the present general inventive concept is not limited thereto, and the guide member 62 can include other structures to guide and support the printing medium 1. For example, the guide member 62 can be a guide rib integrally formed on the printer body.

The discharging passage 70 discharges the printing medium 1 outside the printer body 10 when the printing of the printing medium 1 is completed. The discharging passage 70 includes a discharging outlet 71 formed in the front wall of the printer body 10, and a discharging guide 72 to guide the printing medium 1 conveyed by the conveying unit 40 toward the discharging outlet 71.

The discharging outlet 70 is formed in the front wall of the printer body 10, i.e., at an opposite side of the retrograding outlet 61 to interpose the printing engine 20 therebetween. The discharging guide 72 extends to a position adjacent to the conveying rollers 41 and 42 from the discharging outlet 70. The discharging guide 72 can be made up of ribs integrally formed with the printer body 10.

The discharging passage 70 branches from the supplying passage 50 at a portion thereof adjacent to the conveying unit 40.

Hereinafter, a printing operation of the photo printer in accordance with an exemplary embodiment of the present general inventive concept will now be described.

First, as illustrated in FIG. 2, to load the printing medium 1 or a plurality of printing media 1, the cover cassette 31 is opened, and then the printing media 1 are loaded on the opened cover cassette 31 and the pickup plate 32.

Then, when a printing command is input, the pickup roller 33 rotates to pick up the upper-most printing medium 1 among the loaded plurality of printing media 1 and supplies the printing medium 1 to the underside of the printing engine 20 through the supplying passage 50. As illustrated in FIG. 3, while the printing medium 1 being supplied to the underside of the printing engine 20 is moved according to a medium conveying process including at least a first, second, third, and fourth steps, a desired image is printed on the printing medium 1.

To be more specific, at the first step, the printing medium 1 being supplied through the C-shaped supplying passage 50 is continuously moved rearward, i.e., retrograded by the conveying rollers 41 and 42 until it is aligned and a rear end 1*b* of the printing medium 1 comes to a printing start position. Next, the printing medium 1 is printed by the printing engine with a developer of yellow color while moving frontward, i.e., toward the discharging passage 70.

At the second step, the printing medium 1, now printed with the developer of yellow color, is again retrograded rearward toward the retrograding passage 60 and then is printed with a developer of magenta color while again moving frontward.

At the third step, the printing medium 1, now printed with developers of magenta and yellow color, is again retrograded and then is printed with a developer of cyan color while again moving frontward.

At the fourth step, the printing medium 1, now printed with developers of cyan, magenta, and yellow color, is retrograded and then is coated with an over-coating agent while again moving frontward. Next, the printing medium 1 is discharged to the outside of the printer body 10 through the discharging outlet 71. As a result, the printing operation of the printing medium 1 is completed.

As described above, the photo printer in accordance with the exemplary embodiment of the present general inventive concept uses the L-shaped retrograding passage 60 when retrograding the printing medium 1. Accordingly, it is not necessary to build a separate space in the rear part of the printer body 10.

While the printing operation described above includes four steps to apply developers of cyan, magenta, and yellow color and a over-coating agent to the printing medium 1, the present general inventive concept is not limited thereto and may include a different number of steps depending on the number of developers with different colors applied, the number of times each developer of color a different color is applied, or the application of the over-coating agent.

Here, it should be noted that although an operation of the TPH 23 has not been explained in detail, the TPH 23 is moved away from the ribbon 21*a* when the printing medium 1 is retrograded, and is pressed against the ribbon 21*a* to be in contact therewith and thus carry out the printing operation when the printing medium 1 is moved frontward.

Figure 4:
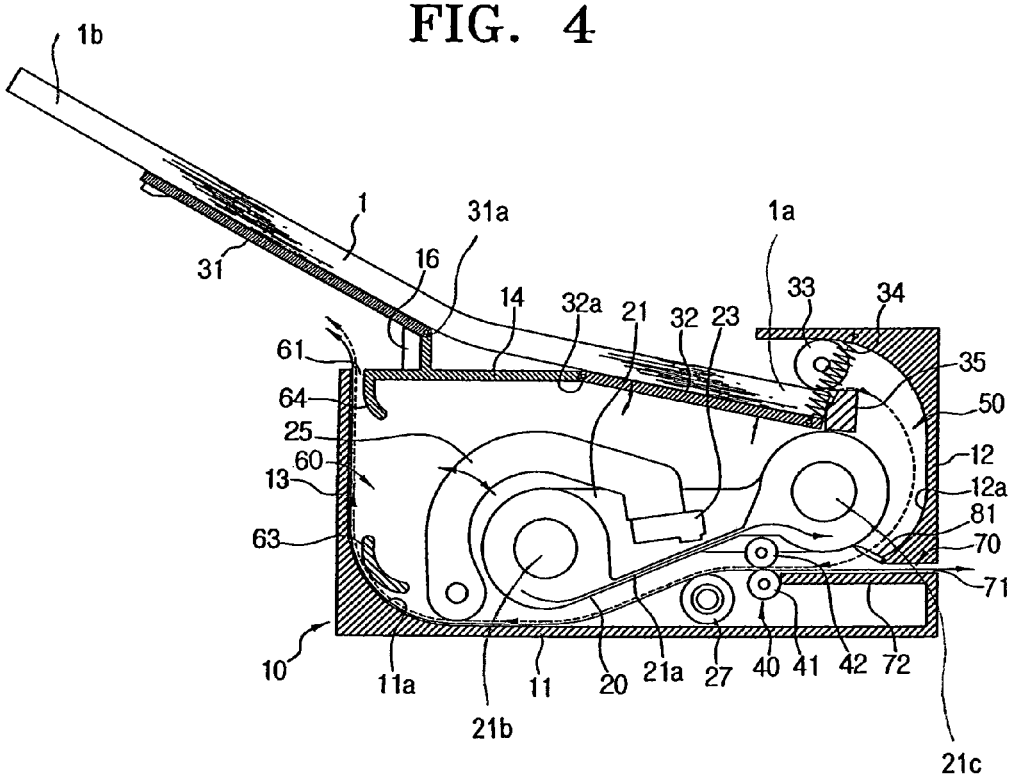
FIG. 4 is a schematic view illustrating a photo printer in accordance with another exemplary embodiment of the present general inventive concept.

FIG. 4 is a schematic view illustrating a photo printer in accordance with another exemplary embodiment of the present general inventive concept. Throughout FIG. 4, similar elements as those of FIGS. 1 and 2 are marked by the same reference numerals, and descriptions thereof are omitted for clarity and conciseness.

Referring to FIG. 4, a first guide member 63 and a second guide member 64 are disposed on a retrograding passage 60 to guide a retrogradation of a printing medium 1. The first guide member 63 can be made up of a guide rib disposed to face a rounded surface 11*a* in a printer body 10. The printing medium 1 is entered and guided between the first guide member 63 and the rounded surface 11*a*.

The second guide member 64 is disposed adjacent to a retrograding outlet 61 to guide the preceding end 1*a* of the printing medium 1 to enter the retrograding outlet 61.

The first and the second guide member 63 and 64 can be integrally formed with the printer body 10 or can be formed and installed separately from the printer body 10.

Figure 5:
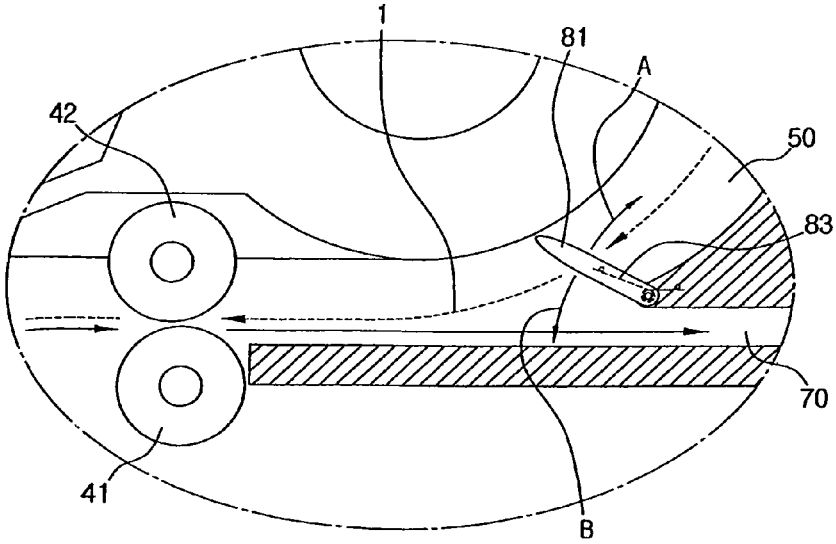
FIG. 5 is a partially enlarged view illustrating a portion of the photo printer of FIG. 4.

Also, a guide lever 81 may be rotatably disposed at a portion of a discharging passage 70, which is branched from a supplying passage 50. As illustrated in FIG. 5, the guide lever 81 is maintained at a position which is elastically biased by a pressing member 83 to block the supplying passage 50. For example, the pressing member 83 can be formed of a torsion spring which presses the guide lever 81 in a direction of arrow A. The pressing member 83 is configured to provide as much elastic force so that the guide lever 81 is rotated in a direction of arrow B by the printing medium 1 when it is supplied through the supplying passage 50, but rotates back in the direction of arrow A to block the supplying passage 50 once the printing medium 1 passes through.

Accordingly, the guide lever 81 is usually maintained at the position to block the supplying passage 50, as illustrated in FIG. 5. However, if the printing medium 1 is supplied through the supplying passage 50, the guide lever 81 is pushed in the direction of arrow B by the supplied printing medium 1 so that the printing medium 1 is supplied toward the underside of the printing engine 20. Then, after the rear end 1*b* of the printing medium 1 has passed by the guide lever 81, the guide lever 81 is rotated in the direction of arrow A by the restoring elastic force of the pressing member 83 to block the supplying passage 50.

To carry out the printing operation, the printing medium 1 is repeatedly moved frontward and rearward with respect to the printing body 10 and then discharged through the discharging passage 70 according to the printing operation described above. During the discharging of the printing medium 1, the printing medium 1 is guided by the guide lever 81 which is disposed at the position to block the supplying passage 50 so that the printing medium 1 is not moved to the supplying passage 50, but is discharged to the outside of the printer body 10 through the discharging passage 70 and the discharging outlet 71.

As described above, according to the exemplary embodiments of the present general inventive concept, the cover cassette is integrally formed with the printer body of a photo printer at the upper portion thereof. Accordingly, it is not necessary to dispose a separate medium cassette in a front or a rear of the printer body. Thus, there is no need for a wide space in order to use the photo printer, thereby allowing the easy and convenient use of the photo printer. Further, there is no need for separate parts, such as the printing medium cassette, thereby reducing the number of parts and manufacturing costs.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A photo printer having a printer body, the photo printer comprising:

a printing unit to form an image on a printing medium;

a sheet feeding system to feed individual sheets of printing medium to the printing unit;

a conveying unit to reciprocate a movement of each individual printing medium during a printing operation;

a supplying unit to supply the printing medium towards the conveying unit;

a supplying passage to guide the supplied printing medium towards the conveying unit;

a retrograding passage having an L-shape and being integrally formed in the printer body to guide and support the reciprocating movement of the printing medium in a rearward direction of the printer body; and a discharging passage to guide and support the reciprocating movement of the printing medium in a frontward direction of the printer body and to guide a discharge of the printing medium to an outside of the printer body.

2. The photo printer of claim 1, wherein the supplying unit comprises:

a cover-cassette pivotably disposed at a top surface of the printer body to pivot between an open position and a closed position to support a rear portion of the printing medium in the open position;

a pickup plate pivotably disposed at the top surface of the printer body to support a front portion of the printing medium; and a pickup roller rotably disposed at the top surface of the printer body and above a first end of the pickup plate to pick up the printing medium supported by the pickup plate and to supply the printing medium toward the conveying unit.

3. The photo printer of claim 2, wherein the supplying unit further comprises:

an elastic member to press the first end of the pickup plate toward the pickup roller, wherein a first end of the elastic member connects to the pickup plate and a second end of the elastic member connects to one of the top surface of the printer body or the pickup roller.

4. The photo printer of claim 2, wherein the pickup plate comprises a pressing member to press the pickup plate to pivot the first end of the pickup plate toward the pickup roller.

5. The photo printer of claim 2, wherein the supplying unit further comprises:

a dam member disposed in the printer body and facing the pickup roller to block and separate a plurality of printing media supported by the pickup plate so that only one of the plurality of printing media is picked up and supplied toward the conveying unit at a time.

6. The photo printer of claim 2, further comprising:

a supporting projection disposed on the top surface of the printer body to support the cover-cassette when placed in the open position.

7. The photo printer of claim 1, wherein the supplying passage comprises:

a curved inside surface of a front wall of the printer body to guide the printing medium towards the conveying unit.

8. The photo printer of claim 7, wherein the printing unit has a rounded surface facing the curved inside surface of the front wall to guide the printing medium towards the conveying unit.

9. The photo printer of claim 7, wherein the supplying passage further comprises:

a guide lever connected to a bottom portion of the curved inside surface of the front wall, to pivot between a blocking and an open position, the guide lever comprising:

a pressing member to continually press the guide lever to the blocking position, wherein the guide lever is moved into the open position by a force of the printing medium being supplied towards the conveying unit and wherein the guide lever moves back into the blocking position to prevent the printing medium from entering the supplying passage during the printing operation after the printing medium has passed the guide lever.

10. The photo printer of claim 9, wherein the supplying passage branches into the discharging passage after the guide lever and the discharging passage comprises:

a discharging guide to guide the reciprocating movement of the printing medium and to guide the discharge of the printing medium after the printing operation is complete; and a discharging outlet to allow a rear portion of the printing medium outside the printer body during the reciprocating movement of the printing medium and to discharge the printing medium after the printing operation is complete.

11. The photo printer of claim 10 wherein the discharging outlet is disposed at a top surface of the printer body.

12. The photo printer of claim 1, wherein the conveying unit comprises:

first and second conveying rollers rotably disposed below the printing unit and in contact with each other to move the supplied printing medium towards the retrograding passage and align a rear end of the printing medium with a print start position, and reciprocate the movement of the printing medium during the printing operation.

13. The photo printer of claim 1, wherein:

the retrograding passage comprises a curved inside surface of a bottom wall and a back wall of the printer body to guide the reciprocating movement of the printing medium during the printing operation from the conveying unit and towards a retrograding outlet and vice versa; and the retrograding passage comprises the retrograding outlet to allow a front portion of the printing medium to be disposed outside the printer body during the printing operation.

14. The photo printer of claim 13, wherein the printing unit comprises a rounded surface facing the curved inside surface of the bottom wall of the printer body to guide the reciprocating movement of the printing medium along the retrograding passage.

15. The photo printer of claim 13, wherein the retrograding passage further comprises:

a first guide member disposed in the printer body and facing a portion of the curved inside surface where the curved inside surface of the bottom wall meets the curved inside surface of the back wall, to guide the printing medium against the portion of the curved surface and along the retrograding passage.

16. The photo printer of claim 13, wherein the retrograding passage further comprises:

a second guide member disposed adjacent to the retrograding outlet to guide the printing medium to enter the retrograding outlet.

17. The photo printer of claim 13, wherein the retrograding outlet is disposed at a top surface of the printer body.

18. The photo printer of claim 1, wherein the discharging passage comprises:

a discharging guide to guide the reciprocating movement of the printing medium and to guide the discharge of the printing medium after the printing operation is complete; and a discharging outlet to allow a rear portion of the printing medium outside the printer body during the reciprocating movement of the printing medium and to discharge the printing medium after the printing operation is complete.

19. The photo printer of claim 18 wherein the discharging passage is disposed at an opposite side to the retrograding passage to interpose the printing unit therebetween, and wherein the retrograding passage is approximately L-shaped.

20. The photo printer of claim 19, wherein the retrograding outlet is disposed at a top surface of the printer body.

21. A photo printer, having a printer body, the photo printer comprising:

a cover-cassette pivotably disposed at a top surface of the printer body to pivot between an open position and a closed position, wherein the cover-cassette placed in the open position supports a printing medium and supplies the printing medium towards a conveying unit;

a supplying passage to guide the printing medium from the cover cassette towards the conveying unit;

a conveying unit to reciprocate a movement of the printing medium during a printing operation, wherein the reciprocating movement moves the printing medium along a retrograding passage and a discharging passage;

a retrograding passage to guide the reciprocating movement of the printing medium; and a discharging passage to guide the reciprocating movement of the printing medium and to guide a discharge of the printing medium to an outside of the printer body after the printing operation is complete.

22. The photo printer of claim 21, further comprising:

a discharging outlet to allow a portion of the printing medium outside the printer body during the reciprocating movement of the printing medium and to discharge the printing medium after the printing operation is complete; and a retrograding outlet to allow a portion of the printing medium to be disposed outside the printer body during the printing operation.

23. An image forming apparatus comprising:

a body in which a printing engine unit is disposed;

a conveying unit to reciprocate a movement of a printing medium fed into the printing engine unit; and a retrograding passage disposed in the body to guide a leading end of the printing medium to an inside and an outside of the body, wherein a printing operation starts from a rear end of the printing medium, wherein the retrograding passage comprises:

a retrograding outlet through which the leading end of the printing medium is discharged to the outside of the body; and a bottom surface and a rear wall disposed in the body to guide the printing medium from a lower portion of the printing engine unit to the retrograding outlet.

24. The image forming apparatus of claim 23, wherein the retrograding outlet is disposed on an upper side of the body.

25. The image forming apparatus of claim 23, wherein the retrograding passage is formed to guide the printing medium in a substantially L-shape.

26. The image forming apparatus of claim 23, wherein the retrograding passage further comprises:

a first guide member to guide the printing medium toward the bottom surface and the rear wall; and a second guide member to guide the printing medium to the retrograding outlet.

27. The image forming apparatus of claim 26, wherein the first guide member comprises an idle roller disposed between the bottom surface and the rear wall.

28. The image forming apparatus of claim 23, further comprising: a discharge passage to discharge the printing medium to the outside of the body after the printing operation of the printing engine unit.

29. An image forming apparatus comprising:

a body in which a printing engine unit is disposed;

a conveying unit to reciprocate a movement of a printing medium fed into the printing engine unit;

a retrograding passage disposed in the body to guide a leading end of the printing medium to an inside and an outside of the body;

a supplying unit disposed in an upper portion of the body to supply the printing medium to the printing engine unit;

a supplying passage to guide the printing medium from the supplying unit to the printing engine unit; and a discharge passage to discharge the printing medium to the outside of the body after a printing operation of the printing engine unit, wherein the printing operation starts from a rear end of the printing medium, wherein the discharge passage branches off from a predetermined potion of the supplying passage, wherein a guide lever is movably disposed on the portion where the discharge passage braches, in order to prevent the printing medium from entering the supplying passage from the printing engine unit after the printing operation and to guide the printing medium to the discharge passage.

30. The image forming apparatus of claim 29, further comprising an elastic member to press the guide lever toward a position to block the supplying passage, wherein the guide lever is pressed by the printing medium supplied through the supplying passage to allow the printing medium to be supplied, and partially blocks the supplying passage due to a recovering force of the elastic member after the printing medium has been supplied.

* * * * *